US011697283B2

(12) United States Patent
Thate et al.

(10) Patent No.: US 11,697,283 B2
(45) Date of Patent: Jul. 11, 2023

(54) MOUNTING DEVICE FOR RECEIVING A HOLLOW CYLINDRICAL OBJECT AND PRINTING SYSTEM

(71) Applicant: Vinventions USA, LLC, Zebulon, NC (US)

(72) Inventors: Karl Helmut Thate, Neustadt an der Weinstrasse (DE); Jens Peter Jäger, Lambrecht (DE)

(73) Assignee: Vinventions USA, LLC, Zebulon, NC (US)

( * ) Notice: Subject to any disclaimer, the term of this patent is extended or adjusted under 35 U.S.C. 154(b) by 0 days.

(21) Appl. No.: 17/282,865

(22) PCT Filed: Mar. 18, 2019

(86) PCT No.: PCT/US2019/022767
§ 371 (c)(1),
(2) Date: Apr. 5, 2021

(87) PCT Pub. No.: WO2020/072093
PCT Pub. Date: Apr. 9, 2020

(65) Prior Publication Data

US 2021/0347164 A1 Nov. 11, 2021

(30) Foreign Application Priority Data

Oct. 4, 2018 (WO) ..... PCT/US2018/054374

(51) Int. Cl.
*B41J 3/407* (2006.01)
*B41F 17/00* (2006.01)
(Continued)

(52) U.S. Cl.
CPC ..... *B41F 17/002* (2013.01); *B41F 17/16* (2013.01); *B41F 17/20* (2013.01); *B41J 2/475* (2013.01);
(Continued)

(58) Field of Classification Search
None
See application file for complete search history.

(56) References Cited

U.S. PATENT DOCUMENTS 6,167,805 B1 1/2001 Williams et al.
6,769,357 B1 8/2004 Finan
2011/0232514 A1* 9/2011 Putzer ..... B41J 2/1714 101/36

FOREIGN PATENT DOCUMENTS

CN 104093793 A 10/2014
EP 2993053 A1 3/2016
(Continued)

OTHER PUBLICATIONS

International Search Report dated Jul. 1, 2019; International Application No. PCT/US2019/022767, filed Mar. 18, 2019.
(Continued)

*Primary Examiner* — Leslie J Evanisko
(74) *Attorney, Agent, or Firm* — Dinsmore & Shohl LLP

(57) ABSTRACT

A mounting device for holding a hollow cylindrical object, particularly a screw cap, in a printing system, comprises a support member, and a mandrel for receiving a hollow cylindrical object arranged at the support member, and a heating device for heating the hollow cylindrical object mounted at the mandrel. A printing system for printing on hollow cylindrical objects, preferably screw caps, comprises at least one mounting device, and at least one printhead configured to print on surfaces of cylindrical objects, preferably screw caps.

27 Claims, 6 Drawing Sheets

(51) Int. Cl.
*B41F 17/16* (2006.01)
*B41F 17/20* (2006.01)
*B41J 2/475* (2006.01)

(52) U.S. Cl.
CPC ..... *B41J 3/4073* (2013.01); *B41J 3/40731* (2020.08); *B41J 3/40733* (2020.08); *B41P 2217/61* (2013.01)

(56) References Cited

FOREIGN PATENT DOCUMENTS

| | | | | | |
|---|---|---|---|---|---|
| JP | 2001180628 | A | * | 7/2001 | |
| JP | 3365907 | B2 | * | 1/2003 | |
| JP | 3589499 | B2 | * | 11/2004 | ..... B65C 3/065 |
| JP | 2013166587 | A | | 8/2013 | |
| JP | 2016084168 | A | * | 5/2016 | |
| JP | 2017131879 | A | | 8/2017 | |
| WO | 2012088053 | A1 | | 6/2012 | |
| WO | 2013085548 | A2 | | 6/2013 | |
| WO | 201516628 | A1 | | 2/2015 | |
| WO | WO-2018083164 | A1 | * | 5/2018 | ..... B41F 17/002 |
| WO | 2020072061 | A1 | | 4/2020 | |
| WO | 2020072093 | A1 | | 4/2020 | |

OTHER PUBLICATIONS

Chilean Office Action, dated Sep. 21, 2022.
Chinese Office Action, dated Oct. 10, 2022.

* cited by examiner

MOUNTING DEVICE FOR RECEIVING A HOLLOW CYLINDRICAL OBJECT AND PRINTING SYSTEM

REFERENCE TO RELATED APPLICATION

This application is the U.S. National Stage of PCT/US2019/022767 filed Mar. 18, 2019, which claims priority to PCT/US2018/054374, filed Oct. 4, 2018, the entire content of both are incorporated herein by reference in their entirety.

FIELD OF THE INVENTION

The present invention relates to a mounting device for receiving a hollow cylindrical object, particularly screw cap, in a printing system. In addition, the present invention relates to a printing system for printing on hollow cylindrical objects, preferably screw caps.

BACKGROUND OF THE INVENTION

As in every other production industry, branding of products is a pivotal strategic and marketing factor for the producers of bottled beverages. When aiming at developing a unique branding for bottled beverages with a largely uniform container design, such as wine bottles with screw caps, the design of the label and the screw cap are essentially the only designable components. For that reason, there is a need for printing systems that enable printing on labels and screw caps. The geometry of the screw caps poses a particular challenge for a corresponding printing apparatus, since screw caps are cylindrical objects with a planar top surface and a cylindrical lateral surface, both of which have to be printed. Such a printing process requires—by far—more advanced technologies than printing on planar labels, for which conventional paper printing technology may be applied.

An exemplary apparatus for printing on cylindrical objects is disclosed by WO 2015/16628 A1. It comprises a plurality of stationary printheads and a holding device for holding the cylindrical objects in a fixed orientation. The holding device moves the cylindrical objects into the vicinity of the printheads such that the printheads may print on the cylindrical object. The fixed orientation of the cylindrical objects ensures a reproducible orientation of the printheads relative to the cylindrical objects, which allows for simplifying the ink feed system needed to feed the ejectors of the printheads.

For holding the caps during printing, it is known to use mandrels which have received a cap from a respective supplying device prior to printing. For printing the caps, it is mandatory that a cap is held in a fixed position and orientation on the mandrel, as the cap is subsequently being printed with several colors. Each printing step for each color has to conform with the preceding and the subsequent printing steps in location and orientation such that the complete graphic to be printed on the cap is correctly applied onto the cap.

Thus, the cap has to be held firmly on the mandrel, hence with a relatively large force. In this regard, it is known to hold the cap received on the mandrel in a fixed position on the mandrel via suction by providing a vacuum to a suction arrangement of the mandrel, as for instance disclosed in U.S. Pat. No. 6,769,357 B1 and U.S. Pat. No. 6,167,805 B1.

It is known to arrange a plurality of mandrels on a mounting device being a component of a printing system such that a plurality of screw caps can be mounted on the mandrels of the mounting device, such that the plurality of screw caps can be handled via moving the mounting device relative to a printhead of the printing system.

The screw caps usually comprise a small wall thickness. Hence, they are of flexible character. That is, when using vacuum for holding the cap in a fixed position on the mandrel, an inner cylindrical surface of the cylindrical portion of the cap and an outer cylindrical surface of the mandrel have to establish a high precision fit. Otherwise, the relatively flexible cylindrical wall of the cap could easily be deformed by the suction force which would lead to distortion of the graphic printed on the deformed cylindrical outer surface or a deformed planar top surface.

In addition, every mandrel of a printing apparatus has to be supplied with a vacuum line which can be controlled independently. Consequently, fixing caps on mandrels by suction requires a complex tubing, provision of a vacuum system and mandrels comprising high precision contact surfaces for receiving the caps. Moreover, constant provision of vacuum to the apparatus leads to high energy expenses. That is, known printing apparatuses are expensive in production and operation.

In digital printing, very small drops of ink are jetted out of the nozzles of a printhead and are deposited on a substrate to create an image. Depending on the surface energy of the substrate to be printed on and the surface tension of the liquid ink that is deposited on that substrate, the ink drops either tend to spread quickly and eventually merge, in case the surface energy of the substrate is higher than the surface tension of the ink, or tend to contract within a very short time in case the surface energy of the substrate is lower than the surface tension of the liquid ink.

The time available between deposition of the ink drops and the start of spreading and merging or contraction is called cure delay. Pinning alters the low viscosity inks into a high viscosity gel that is substantially immobile and is not to able spread or contract anymore, but is still flexible and allows the deposition and stable adhesion of subsequently printed inks or varnishes. Hence, curing or drying of the ink should start before spreading or contraction, respectively, of the ink drops. In order to prevent uncontrolled spreading or contraction of the ink drops, respectively, the ink drops, hence, need to be pinned directly after they touch the substrate.

In ordinary printing systems for printing screw caps, UV-curing inks are utilized. For pinning the ink, a short pulse of a low intensity UV-light is directed onto the ink immediately after deposing the ink.

Although aqueous inks comprise several advantages compared to UV-curing inks, aqueous inks have not been utilized for printing on three-dimensional objects yet. Pinning of aqueous inks is done thermally by a slight pre-heating of the substrate. However, it is mandatory that the substrate to be printed is evenly heated such that every location of the substrate comprises substantially the same temperature, as the latter is required for obtaining an even and high-quality printing result. Temperature differences on the substrate surface lead to differences in the spread of the ink drops. Differences in the ink spread, in turn, cause differences in the image quality.

SUMMARY OF THE INVENTION

It is an object of the present invention to provide an improved mounting device for receiving a hollow cylindrical object, preferably a screw cap, in a printing system.

The above object is solved by a mounting device for holding a cylindrical object, particularly a screw cap, in a printing system as defined herein, and by a printing system as defined herein. Preferred embodiments are set forth in the present specification and the Figures.

Specifically, the present invention suggests a mounting device for holding a cylindrical object, particularly a screw cap, in a printing system, comprising a support member, and a mandrel for receiving a hollow cylindrical object arranged at the support member. The mounting device further comprises a heating device for heating the hollow cylindrical object mounted at the mandrel.

In that the mounting device comprises a heating device for heating the hollow cylindrical object mounted at the mandrel, it is possible to pre-heat the hollow cylindrical object mounted on the mandrel to a predetermined temperature range prior to printing and to maintain the temperature of the hollow cylindrical object within the predetermined temperature range during printing. Thus, thereby it is possible to utilize aqueous ink for printing the hollow cylindrical object and achieve an even and high-quality printing result.

According to a preferred embodiment the heating device is configured to heat the hollow cylindrical object from an outer side of the hollow cylindrical object. Thereby, the mounting device and the heating device may comprise a particularly unsophisticated structure.

Alternatively or in addition, the heating device is configured to heat the hollow cylindrical object from an inner side of the hollow cylindrical object. Heating the hollow cylindrical object from an inner side may be more efficient than heating the hollow cylindrical object from an outside of the object, as a heat dissipation towards the hollow cylindrical object may be more effective and external influences may be reduced.

In this regard, the terms "inner side" and "outer side" of the hollow cylindrical object are understood in relation to a radial position with respect to a cylindrical lateral wall of the hollow cylindrical object. With other words, the "inner side" is the side enclosed by the lateral wall of the hollow cylindrical object and the "outer side" corresponds to the side beyond the lateral wall of the hollow cylindrical object, hence, the side of the hollow cylindrical object which is to be printed.

For providing heat for heating the hollow cylindrical object, the heating device may optimally comprise an internal heating unit.

According to a preferred embodiment, the internal heating unit comprises a heat source, preferably a heating wire, more preferably a plurality of heating wires.

For providing efficient heating of the hollow cylindrical object, the heating unit may preferably be arranged to heat an outer surface of the mandrel. Alternatively or in addition, the heating unit may be arranged to heat a fluid, preferably air, being directed to the mandrel.

According to a preferred embodiment, the heating device comprises a wireless induction unit for wireless induction heating of the hollow cylindrical object, and/or the heating device comprises an infrared heating unit for emitting infrared radiation.

According to another preferred embodiment, the heating device comprises a fluid supply conduit for supplying a flow of heating fluid to the mandrel. The heating fluid, thus, may be utilized as a carrier for directing heat generated offset or spaced apart from the hollow cylindrical object to the hollow cylindrical object.

Preferably, the mandrel comprises a heating fluid passage for directing the flow of fluid towards an inner surface of the hollow cylindrical object. Hence, the heating fluid can be heated remote from the hollow cylindrical object and conducted to the position of the hollow cylindrical object.

In this regard, the mandrel preferably comprises a mounting sleeve comprising the form of a hollow cylinder, wherein preferably, the heating fluid passage is arranged inside the mounting sleeve, wherein preferably, the mounting sleeve comprises one or more openings being in fluid communication with the heating fluid passage.

When one or more spacers are arranged on an outer surface of the mounting sleeve for providing a gap between the outer surface of the mounting sleeve and an inner surface of the hollow cylindrical object, it may be possible feed the heating fluid into the gap. The heating fluid, thus, may be able to heat the hollow cylindrical object via heat convection. Hence, an even heat distribution to the hollow cylindrical object may be achieved. Preferably, the heating fluid is fed into the gap such that a substantially even fluid circulation inside the gap is maintained.

Preferably, the one or more spacers are arranged on an outer lateral surface of the mounting sleeve and/or on an outer end face of the mounting sleeve. Thereby, heating fluid may come in contact with the majority of an inner lateral surface of the hollow cylindrical object and/or the inner surface of the top face of the hollow cylindrical object.

According to another preferred embodiment the mounting sleeve extends along a longitudinal axis and comprises an expansion region, wherein the mandrel further comprises a core arranged inside the mounting sleeve, wherein the core is movable in relation to the mounting sleeve, wherein the core is configured to be positioned in a first position of the core relative to the mounting sleeve in which the expansion region is in a not expanded state, and configured to be positioned in a second position of the core relative to the mounting sleeve in which the core exerts a radial force onto the expansion region such that the expansion region is radially expanded with regard to the expansion region in the not expanded state.

Thereby, it is possible to compensate a thermal expansion of the mandrel and/or a thermal expansion of the hollow cylindrical object due to the heating provided by the heating device. Moreover, it thereby is possible to ensure straightforward mounting of the hollow cylindrical object onto the mounting sleeve and to also ensure a rigid fixation of the hollow cylindrical object. As the expansion region of the mounting sleeve is able to change its diameter, in the not expanded state, the outer diameter of the mounting sleeve can be set smaller than the inner diameter of the hollow cylindrical object to be held by the mandrel. Hence, the hollow cylindrical object can easily be put onto the mandrel, at least onto the mounting sleeve. Moreover, it is not required to hold the hollow cylindrical object via suction onto the mandrel. Hence, it is possible to both fix the hollow cylindrical object onto the mandrel and provide heating of the hollow cylindrical object by means of supply of the heating fluid.

Consequently, providing a heating device having a heating unit for heating a fluid and directing the heated fluid into the mandrel in combination with providing the mandrel with the mounting sleeve comprising the expansion region may enable both (pre-)heating of the hollow cylindrical object together with ensuring secure mounting of the hollow cylindrical object on the mandrel. With other words, providing the mounting device with such an expandable mandrel may enable the possibility of supplying the heating fluid form an inner side of the mandrel, in particular an inner side of the cylindrical mounting sleeve and, hence, in combination lead to a particularly beneficial preferred solution of the above object.

For providing the fixation of the hollow cylindrical object on the mandrel, the diameter of the expansion region is widened to a predetermined extent such that a friction fit of a predetermined value can be applied between the outer surface of the expansion region and the inner surface of the hollow cylindrical object received by the mandrel.

Consequently, the present invention does not require a vacuum system anymore and its elaborate tubing arrangement. Also, the tolerance range for the distance of the inner diameter of the hollow cylindrical object and the outer diameter of the mandrel, in particular of the mounting sleeve, is typically smaller compared to a mandrel utilizing vacuum for fixation of the hollow cylindrical object. Moreover, changes in length in the radial direction due to heating of the both the mandrel and the hollow cylindrical object may be compensated for both the mandrel and the hollow cylindrical object, such that secure holding of the hollow cylindrical object may be possible even when heating the hollow cylindrical object for printing.

Preferably, the core is movable at least between the first position and the second position, wherein preferably, the movement is a displacement in the direction of the longitudinal axis.

Furthermore, the mounting sleeve is preferably made in one piece.

According to a preferred embodiment, the mounting sleeve comprises a sleeve wedge structure on an inner surface thereof. The core preferably comprises a core wedge structure formed complementary to the sleeve wedge structure, wherein, in the first position of the core relative to the mounting sleeve, the sleeve wedge structure and the core wedge structure are configured to be arranged relative to each other such that the expansion region is in the not expanded state. In the second position of the core relative to the mounting sleeve, the core wedge structure is configured to exert a radial force onto the sleeve wedge structure such that the expansion region is radially expanded with regard to the expansion region in the not expanded state. Thereby, the extent of expansion of the expansion region can be predetermined via the angle formed by the longitudinal axis and the contacting surfaces of the wedge structures. Furthermore, due to the wedge kinematics, thus, the mechanical advantage caused by the wedge mechanism in relation to an input force onto the core in direction of the longitudinal axis and a resulting radial force excreted onto the sleeve by the core, a relatively high radial force can be applied by means of a relatively small actuating force applied to the core in the direction of the longitudinal axis. Hence, the mandrel may exhibit an advantageously unsophisticated and robust structure. Preferably, the sleeve wedge structure and also the core wedge structure are arranged in the expansion region with respect to the longitudinal axis. With other words, the sleeve wedge structure and also the core wedge structure preferably extend in its entirety within the limits of the expansion region with respect to the longitudinal axis.

The sleeve wedge structure preferably comprises at least one contact surface which is inclined in relation to the longitudinal axis. That is, the at least one inclined contact surface and the longitudinal axis enclose a predetermined angle. In addition, the core wedge structure preferably comprises at least one inclined contact surface formed complementary to the inclined surface of the sleeve wedge structure. Thus, also the at least one inclined contact surface and the longitudinal axis enclose the predetermined angle. With other words, the at least one contact surface of the sleeve wedge structure and the commentary formed at least one contact surface of the core wedge structure are aligned parallel to each other. By movement of the core relative to the sleeve, hence, the core's contact surface is displaced relative to the sleeve's contact surface such that, when the contact surfaces are in contact with each other, displacement of the core relative to the sleeve causes the core's contact surface to slide along the sleeve's contact surface.

According to a preferred embodiment, the sleeve and also the core comprise a substantially rotationally symmetric shape, wherein the core wedge structure comprises a substantially tapered form and the sleeve wedge structure comprises a respectively shaped inner surface, thus, a basic cylindrical form with a cutout having a tapered form. Thereby, the radial force can be applied onto the mounting sleeve substantially along the entire circumference of the mounting sleeve which results in a particularly even radial widening of the mounting sleeve.

In a preferred embodiment, the angle enclosed by the contact surface of the sleeve and the longitudinal axis and respectively the angle enclosed by the core and the longitudinal axis is smaller than 45°. Hence, a force exerted onto the core in direction of the longitudinal axis causes a radial force onto the sleeve via the contacting contact surfaces of the core wedge structures bigger than the value of the force in the longitudinal axis. The smaller the angle, the bigger the resulting radial force as a constant axial force is applied via the core onto the mounting sleeve. With other words, the resulting radial force increases with decreasing angle at constant applied axial force.

Preferably, the angle between the contact surface and the longitudinal axis is between 1° and 40°, preferably 5°-30°, particularly preferably 10°-30° and very particularly preferably 10°, 15°, 20°, 25° or 30°. Particularly preferably, the angle is in the range of 16° to 19°. Thereby, self-locking between the core and the sleeve can be avoided and at the same time a high mechanical advantage, with other words the ratio of the radial force compared to the longitudinal force, can be provided.

According to another preferred embodiment, that object is realized by the sleeve wedge structure, which comprises a plurality of wedge ring segments arranged adjacent to each other in relation to the longitudinal axis, and, in particular, by the core sleeve structure, which comprises a plurality of wedge ring segments arranged adjacent to each other in relation to the longitudinal axis and complementarily formed in relation to the wedge ring segments of the sleeve wedge structure. Thereby, the core is typically movable relative to the mounting sleeve in direction of the longitudinal axis. That is, the radial force applied by the extended expansion region onto the hollow cylindrical object can be distributed uniformly along the expansion region in relation to the longitudinal axis. Hence, deformation of the hollow cylindrical object due to the fixation of the hollow cylindrical object on the mandrel may be significantly reduced, e.g. to a minimum or even completely avoided. In addition, the individual ring segments may comprise a relatively small radial extension inwardly towards the longitudinal axis of the mandrel. Also, displacement in the direction of the longitudinal axis of the core relative to the mounting sleeve may be small compared to an embodiment comprising only one continuous wedge extending over the entire length of the expansion region. With other words, the core wedge structure comprises a plurality of truncated cones arranged adjacent to each other in relation to the longitudinal axis.

Accordingly, the wedge ring structure comprises a plurality of complementary formed wedge rings extending from the hollow cylindrical basic form of the sleeve inwards in relation to the longitudinal axis.

According to another preferred embodiment, the sleeve wedge structure comprises an internal thread, wherein the flanks of the internal thread comprise the shape of a wedge, and the core wedge structure comprises an external thread. Therein, the flanks of the external thread may comprise the shape of a wedge formed complementary to the flanks of the internal thread. With other words, one of the thread flanks of the internal thread is inclined about a predetermined angle in relation to the longitudinal axis forming a helical contact surface of the wedge structure. Accordingly, the external thread comprises a flank inclined in relation to the longitudinal axis about the predetermined angle and forming a helical contact surface, too, such that the inclined contact surface of the external flank can slide over the contact surface of the internal thread. That is, the inclined flanks of the internal thread and the external thread interact with each other and thereby form a helically formed wedge mechanism.

The core is preferably movable relative to the mounting sleeve in the direction of the longitudinal axis or the core is rotatable about the longitudinal axis relative to the mounting sleeve. Thereby, radial extension of the expansion region may occur advantageously evenly over the whole length of the expansion region. That is, the radial force applied by the extended expansion region onto the hollow cylindrical object can distributed uniformly in relation to the direction of the longitudinal axis, and thus, over substantially the entire contact region of the expansion region and the hollow cylindrical object. Hence, deformation of the hollow cylindrical object by fixation to the mandrel may be significantly reduced, e.g. to a minimum or even completely avoided.

In addition, the flanks of both the mounting sleeve and the core may comprise a relatively small radial extension. Also, displacement in the direction of the longitudinal axis of the core relative to the mounting sleeve may be smaller compared to an embodiment comprising only one continuous wedge extending over the entire length of the expansion region. Compared to the embodiment comprising consecutive ring segments, distribution of the radial force onto the mounting sleeve and further onto the hollow cylindrical object can be uniformly achieved.

Moreover, by means of the thread, the sleeve and the core can easily be demolded during their production. The same applies to an assembly of the mounting sleeve and core, as the core can readily be screwed into the mounting sleeve without requiring displacement of the sleeve radially outwards.

It is preferred that the pitch and the lead, respectively, of the threads is relatively small, hence smaller of for instance the pitch and lead of a metric thread corresponding to the diameter of the threads, preferably the lead angle and pitch angle, respectively, is smaller than 3°, particularly preferably smaller than 2°, and very particularly preferably smaller than 1.5° or 1°.

Furthermore, the angle enclosed between the contacting surface of the inclined flank of the internal thread and the longitudinal axis and thus between the contacting surface of the inclined flank of the external thread and the longitudinal axis is preferably between 1° and 40°, preferably 5°-30°, particularly preferably 10°-30° and very particularly preferably 10°, 15°, 20°, 25° or 30°. Particularly preferably, the angle is in the range of 16° to 19°. Thereby, self-locking between the core and the sleeve can be avoided and at the same time a high mechanical advantage, with other words the ratio of the radial force compared to the longitudinal force, can be provided.

For expanding the mounting sleeve, due to the thread, the core may be displaceable in the direction of the longitudinal axis and may be fixed against rotation about the longitudinal axis relative to the mounting sleeve according to a first alternative. By a second alternative, the core may be fixed against displacement in the direction of the longitudinal axis and be rotatable about the longitudinal axis in relation to the mounting sleeve.

According to another preferred embodiment, the mounting sleeve comprises a lid or cover portion as a separate component, preferably a removable component. Thereby, it is possible to insert the core and, optionally, to also insert a bias member through the open top of the mounting sleeve and close the top by the lid or cover portion.

In order to provide a particularly simple and robust structure, the mandrel may further comprise a bias member, as suggested according to another preferred embodiment, preferably a spring, for biasing the core in a fixed position, preferably the first position or the second position, wherein the bias member is preferably supported against a support element or support region of the mandrel.

According to another preferred embodiment, the mandrel further comprises an actuator member for moving the core between the first position and the second position. Hence, the position of the core can readily be predetermined and controlled. Preferably, the actuator member is configured for interacting with a cam, wiper, lobe or a guiding of the mounting device or of the printing system.

In order to enable removal of the hollow cylindrical object from the mandrel in a controllable manner, the mandrel may preferably further comprise a mechanical ejector for mechanically removing, preferably pushing off, the cylindrical object from the mandrel, and/or further comprise a pneumatic ejector for removing the cylindrical object from the mandrel utilizing compressed air. Preferably, the pneumatic ejector comprises a valve and/or a connection to a pneumatic air supply system.

According to yet another preferred embodiment, in the not expanded state, the mounting sleeve exhibits a maximum outer diameter equal to or slightly smaller than the inner diameter of a cylindrical object to be received by the mandrel. In the expanded state, the expansion region exhibits a maximum outer diameter greater than the inner diameter of the cylindrical object to be received by the mandrel. The term "slightly" is to be understood as a clearance or gap resulting from the difference of the inner diameter of the cylindrical object and the outer diameter of the mounting sleeve is smaller than the expansion of the mounting sleeve resulting from the motion of the core from the first position to the second position. Preferably, in the not expanded state, the maximum diameter of the mounting sleeve is about 0.01 mm-0.5 mm, particularly preferably 0.05 mm-0.1 mm smaller than the inner diameter of the hollow cylindrical object. The maximum outer diameter of the mounting sleeve is preferably set to a value such that a clearance fit is established by the inner circumferential surface of the hollow cylindrical object and the outer surface of the mounting sleeve in the not expanded state.

Straight-forward mounting of the hollow cylindrical object onto the mandrel and in addition robust and save fixation of the hollow cylindrical object on the mandrel can be achieved. According to another preferred embodiment, the difference in the diameter of the expansion region in the not expanded state and the diameter of the expansion region in the expanded state is in the range of 0.05 mm-0.5 mm, preferably 0.1 mm-0.4 mm, particularly preferably 0.05, 0.075, 0.1, 0.15, 0.2, 0.25, 0.3 or 0.4, or any range defined by the aforementioned values.

Preferably, the mounting sleeve comprises a plurality of slots substantially extending along the longitudinal axis being arranged in a circumferential direction in relation to the longitudinal axis for forming the expansion region. Fins or ribs, respectively, are formed and may be expanded in the radial direction. Thus, each single fin or rib may be bent independently, as the fins or ribs are not connected by each other in the circumferential direction due to the provision of slots.

Preferably the slots are in fluid communication with the heating fluid passage. Hence, the slots may further function as passage openings of the heating fluid passage by which heating fluid is fed towards the inner surface of the hollow cylindrical object, wherein preferably the heating fluid is led into the gap formed between the outer surface of the mounting sleeve and the inner surface of the hollow cylindrical object.

Preferably, the slots are provided as elongated openings extending in the direction of the longitudinal axis and/or exhibit a sinusoidal shape extending in the direction of the longitudinal axis.

According to a preferred embodiment, the slots may not extend over the entire length of the mounting sleeve with respect to the longitudinal axis, but are arranged in direction of the longitudinal axis between a first end portion of the mounting sleeve, for instance an upper end portion, such as a portion adjacent to a lid portion, and a second end portion of the mounting sleeve, for instance a lower end portion. Hence, according this optional embodiment, the mounting sleeve may comprise end portions being rigid with respect to the expansion region, which consequently may substantially not radially expand due to an exertion of radial force via the core wedge structure onto sleeve wedge structure. The expansion region provided by the slots, thus, extends between the first and second end portions.

According to a preferred embodiment, the slots are arranged such that, in the expansion region, the mounting sleeve comprises a plurality of ribs extending along the longitudinal direction.

Preferably, one or more ribs comprise a spacer, wherein preferably each rib comprises a spacer. Preferably, the spacers comprise the form of thin ledges or slats extending along the longitudinal axis. When the spacers comprise a waveform shape or a sinusoidal shape, respectively, both a particularly even pressure distribution onto the hollow cylindrical object and an even heat distribution via the heating fluid in the gap provided by the spacers may be obtained.

According to a preferred embodiment, the heating device comprises a flow generating unit, preferably a pump or a fan, for providing a fluid flow, preferably an air flow in the heating device. Thereby, a steady flow of fluid may be provided inside the heating device, onto the hollow cylindrical object, inside the mandrel and/or in the gap between the mounting sleeve and the hollow cylindrical object.

When the heating device comprises a fluid return conduit for redirecting fluid from the mandrel towards the heating unit, it may be possible to collect the fluid which has been used for heating the hollow cylindrical object and redirect it to the heating unit. Hence, the already heated fluid merely has to be brought back to the predetermined heating temperature. A complete heating of new fluid, for example ambient air, can be avoided.

Preferably, the fluid, preferably air, is heated to a temperature range between 45° C. to 65° C., preferably between 50° C. to 60° C., and particularly preferably heated to comprise an average temperature of 50° C., 51° C., 52° C., 53° C., 54° C., 55° C., 56° C., 57° C., 58° C., 59° C. or 60° C.

Preferably, a temperature sensor is arranged for determining the temperature of the heated fluid. The temperature sensor is preferably arranged between the heating unit and the mandrel, wherein preferably, the temperature sensor is arranged close to a fluid inlet provided at the mandrel.

According to another preferred embodiment, the mandrel is rotary supported on the support member, wherein the mandrel is rotatable about the longitudinal axis. Thereby, the hollow cylindrical object may be positioned according to whatever desired orientation for the printhead of the printing system to exert the printing activity.

Preferably, the heating device comprises a heating area arranged adjacent to the mandrel for heating an outer lateral surface of the hollow cylindrical object. Hence, evenly heating of the lateral surface of the hollow cylindrical object may be achieved by rotating the hollow cylindrical object about the longitudinal axis.

According to a preferred embodiment, a plurality of mandrels is arranged on the support member in a circumferential direction about a center axis, wherein preferably the support member is rotatable about the center axis. Thereby, it is possible to handle a plurality of hollow cylindrical objects by means of one mounting device. An output of a printing system comprising a such designed mounting device may be correspondingly higher than an output of a printing system comprising mounting devices containing only one mandrel.

For enabling printing on the top surface of the hollow cylindrical object and on the lateral surface of the hollow cylindrical object, the mounting device may comprise a tilting device for tilting the support member relative to a reference plane.

According to another preferred embodiment, the heating device comprises a connection unit for connection to an external heat source. Hence, the mounting device may be designed comprising a lightweight design and an unsophisticated structure.

According to another preferred embodiment, the mounting device further comprises a battery and/or a contact unit preferably comprising a sliding contact, preferably a brush, for electrical connection with an electrical power supply. Thereby, it may be possible to supply components of the mounting device, for example the heating device and/or a driving device such as an electric motor for rotating the mandrel and/or the support member and/or for tilting the support member with electrical energy.

According to another aspect, a printing system for printing on hollow cylindrical objects, preferably screw caps, is suggested, comprising at least one mounting device as defined herein, and at least printhead configured to print on surfaces of cylindrical objects, preferably screw caps.

The printing system realizes the advantages and effects described above in relation to the mounting device analogously.

Preferably, at least one printhead is configured for printing an aqueous ink.

BRIEF DESCRIPTION OF THE DRAWINGS

The above and further features and advantages of the invention will become readily apparent from the following detailed description of preferred embodiments of the invention with reference to the accompanying drawings, in which reference signs designate features, and in which.

DETAILED DESCRIPTION OF THE INVENTION

The person skilled in the art is well aware that these embodiments and items only depict examples of a plurality of embodiments. Hence, the embodiments shown here should not be understood as limiting. Any combination and configuration of the described features within the scope of the invention is encompassed as well.

Figure 1:
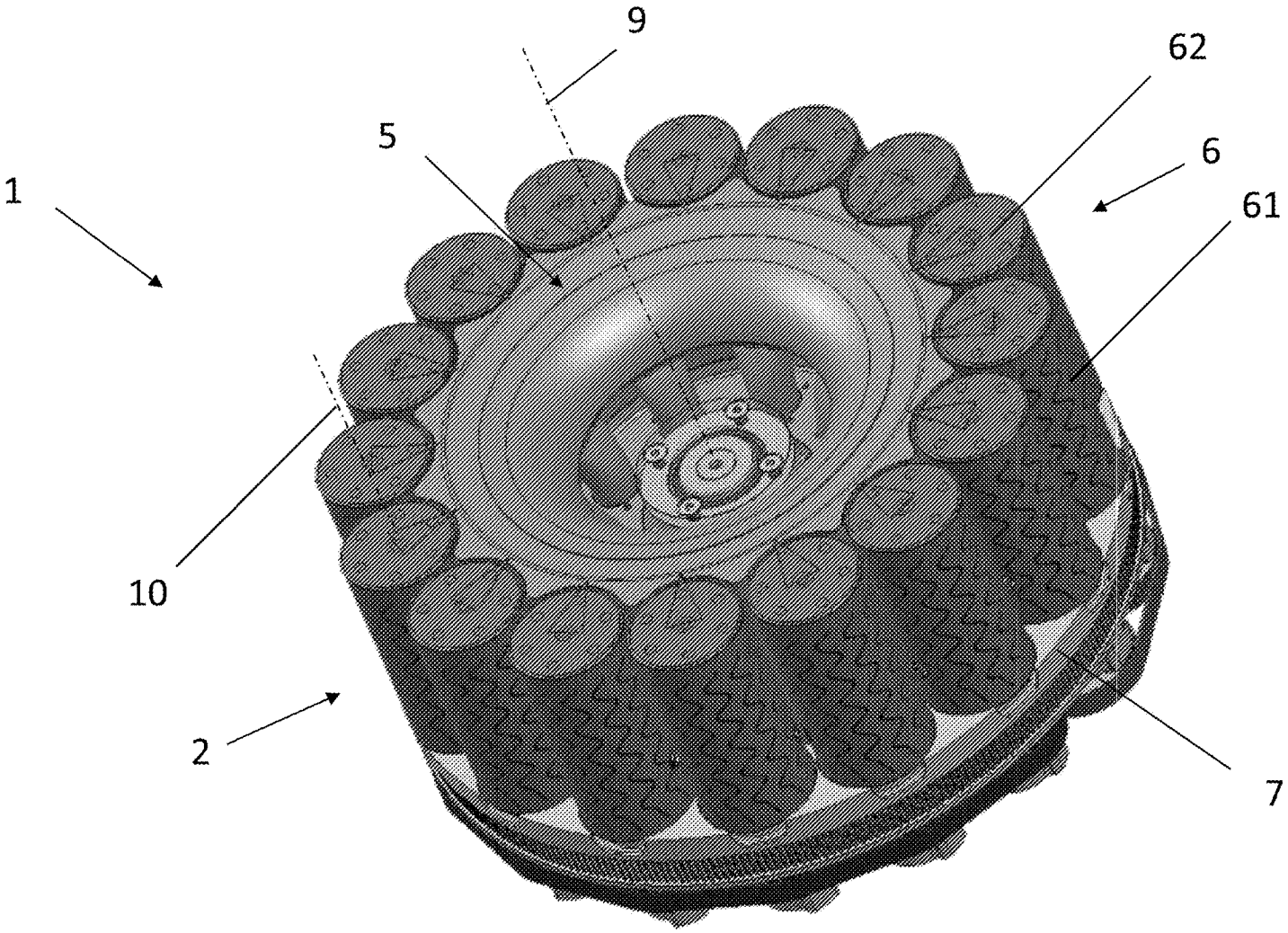
FIG. 1 is a schematically a perspective side view of a mounting device for holding a plurality of hollow cylindrical objects.

FIG. 1 schematically shows a perspective side view of a mounting device 1 for holding a plurality of hollow cylindrical objects 6, here in the form of screw caps, in a printing system. The mounting device 1 comprises a support member 7 and a plurality of mandrels 2 for receiving a hollow cylindrical object 6, which are arranged at the support member 7 in a circumferential direction with respect to a center axis 9 of the mounting device 1. Each mandrel 2 is rotatable about a longitudinal axis 10 with respect to the support member 7 by means of bearings 8 (see FIG. 5).

The mounting device 1 further comprises a heating device 5 for heating the hollow cylindrical objects 6 mounted at the mandrels 2. The heating device 5 according to this exemplary embodiment is configured to heat the hollow cylindrical object 6 from an outer side of the hollow cylindrical object 6 and from an inner side of the hollow cylindrical object 6, as will be described in more detail below. The heating device 50 is substantially arranged radially inwards with respect to the circumferential arrangement of the plurality of mandrels 2.

Figure 2:
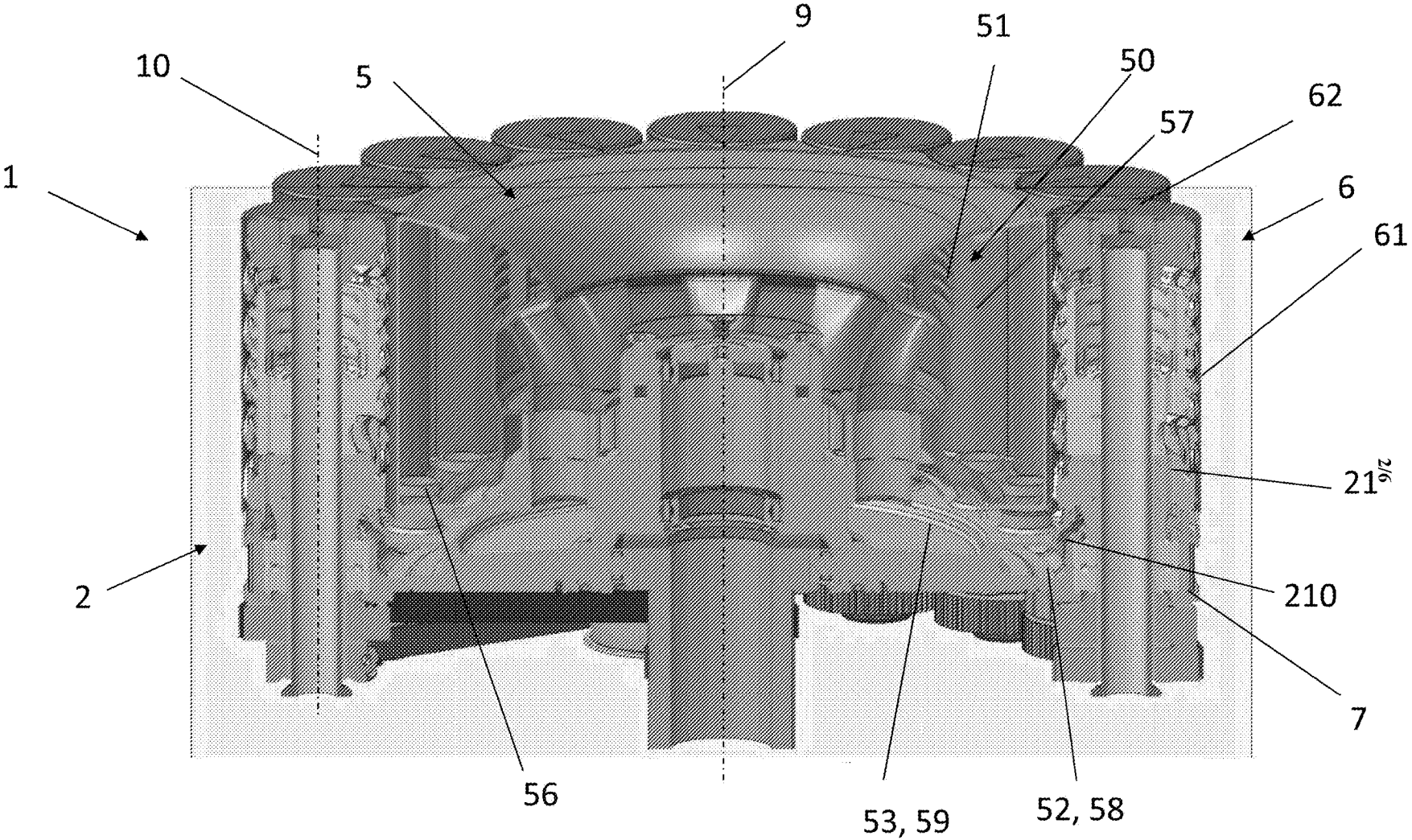
FIG. 2 is a schematically shows a perspective sectional view through the mounting device of FIG. 1.

FIG. 2 schematically shows a perspective sectional view through the mounting device 1 of FIG. 1. The heating device 5 comprises an internal heating unit 50 containing a plurality of heating wires 51, which are arranged in a circumferential direction with respect to the center axis 9.

Here, the heating unit 50 is configured to heat a fluid, which in this embodiment is air. For providing a flow of air to the heating unit 50, the heating device 5 comprises a flow generating unit (see FIGS. 3 and 4) which moves air from the radial inner side of the mounting device 1 towards and through the heating wires 51. The heating wires 51 heat the air when passing the wires 51 substantially by means of convection.

The heating device 5 further comprises a fluid supply conduit 52 through which the flow of heating fluid heated by the wires 51 is supplied to the mandrels 2. In detail, the heated air is directed from a heating chamber 57 accommodating the heating unit 50 via a plurality of tubes 56 into a supply ring chamber 58 and into heating fluid passages 21 of the mandrels (see FIG. 5). Hence, the tubes 56 and the supply ring chamber 58 substantially form the fluid supply conduit 52.

As will be described in more detail with respect to FIGS. 5 and 6, the flow of heated air is directed through the mandrels 2 to heat up an inner side of the hollow cylindrical objects 6. After the heated air has been conducted through a mandrel 2, it exits the mandrel 2 into a return chamber 59 which is in fluid communication with the flow generating unit 55, such that the air used for heating the hollow cylindrical objects 6 can be supplied back to the heating unit 50 and, thus, can be reused for heating the hollow cylindrical objects 6. With other words, a substantially closed loop of flow of heated and reheated air is generated.

According to this embodiment, the air is heated by the heating unit 50 to a temperature between 50° C. and 55° C., wherein the temperature is measured close to an inlet 21 of a heating fluid passage 21 arranged in the mandrel 2 by an optional temperature sensor (not shown). Alternatively or in addition, the temperature of an outer surface of the hollow cylindrical object 6 may be detected.

Figure 3:
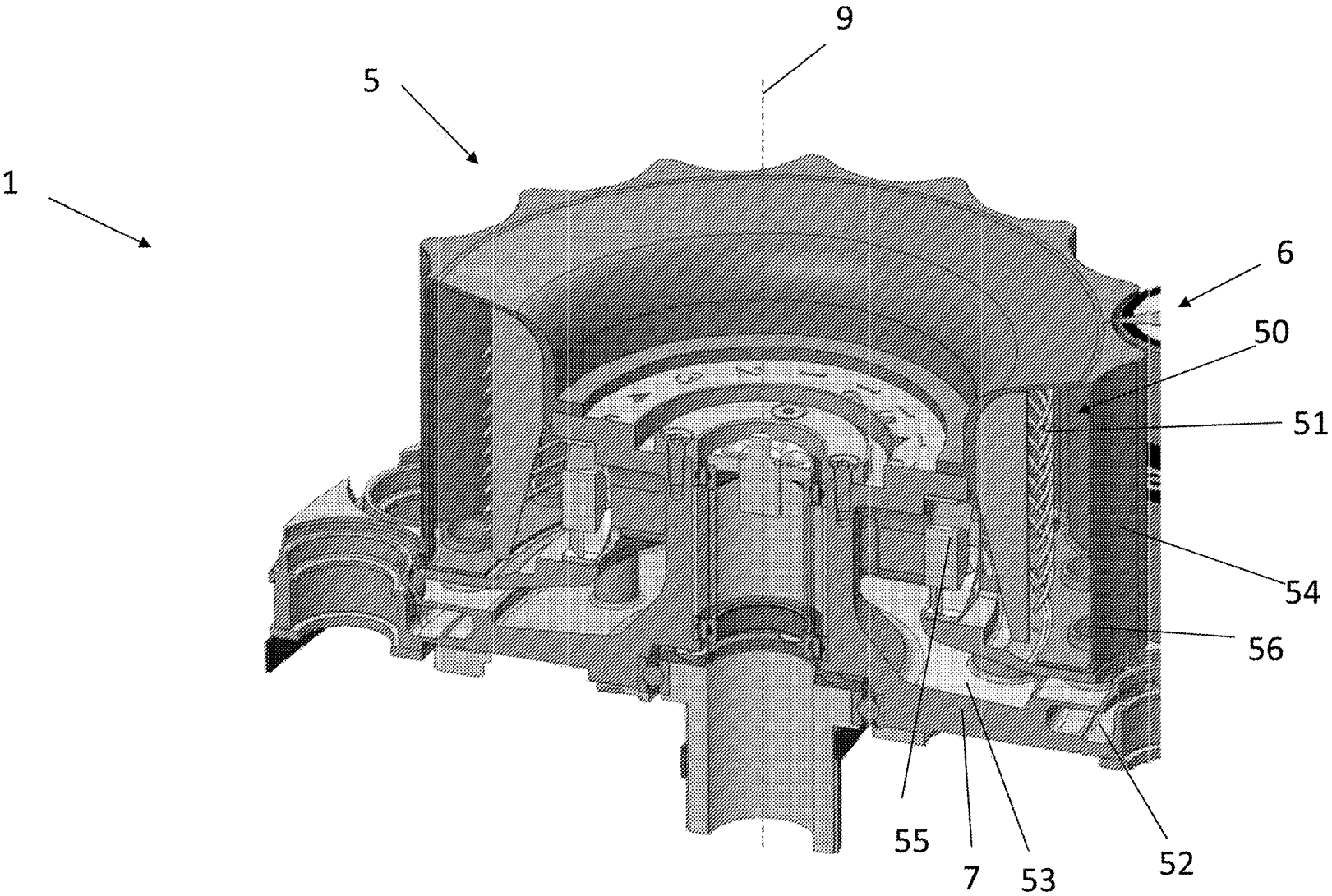
FIG. 3 is a schematically shows a perspective sectional view of the mounting device according to FIGS. 1 and 2.

FIG. 3 is another schematic perspective sectional view of the mounting device 1 according to FIGS. 1 and 2, wherein loop merely one mandrel 2 holding a hollow cylindrical object 6 is shown. The sectional cut is slightly shifted with respect to the sectional cut shown in FIG. 2, such that the closed circle for the flow of air realized by means of the fluid supply conduit 52, the fluid return conduit 53 and the flow generating unit 55 can be seen in detail.

Moreover, the heating device 5 further comprises a heating area 54 arranged adjacent to the lateral outer side of the mandrels 6 such that an outer lateral surface 61 of the hollow cylindrical object 6 can be heated from an outer side of the hollow cylindrical object 6. An even heating effect on the lateral surface 61 of the hollow cylindrical object 6 may be achieved by rotating the hollow cylindrical object 6 about the longitudinal axis 10. Hence, heat radiated by the heating area 54 towards the hollow cylindrical object 6 is subsequently absorbed by the entire lateral surface 61. Hence, the heating area 54 supports heating or tempering the outer lateral surface 61 of the hollow cylindrical object 6.

With other words, the hollow cylindrical objects 6 are heated by the heating device 5 both from an inner side and an outer side of the hollow cylindrical objects 6.

Figure 4:
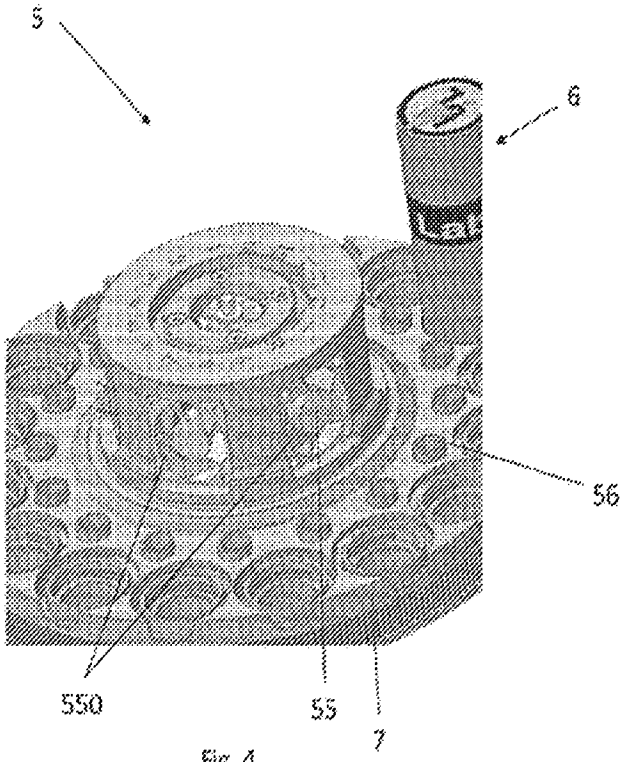
FIG. 4 is a schematically shows a perspective side view of the mounting device according to FIGS. 1 to 3.

FIG. 4 schematically shows a perspective side view of the mounting device 1 according to the preceding Figures, wherein the heating chamber 57 and the mandrels 2 are hidden, such that plain sight on the flow generating unit 55 is provided. The flow generating unit 55 comprises a plurality of fans 550 evenly distributed along a circumferential direction with respect to the center axis 9.

Figure 5:
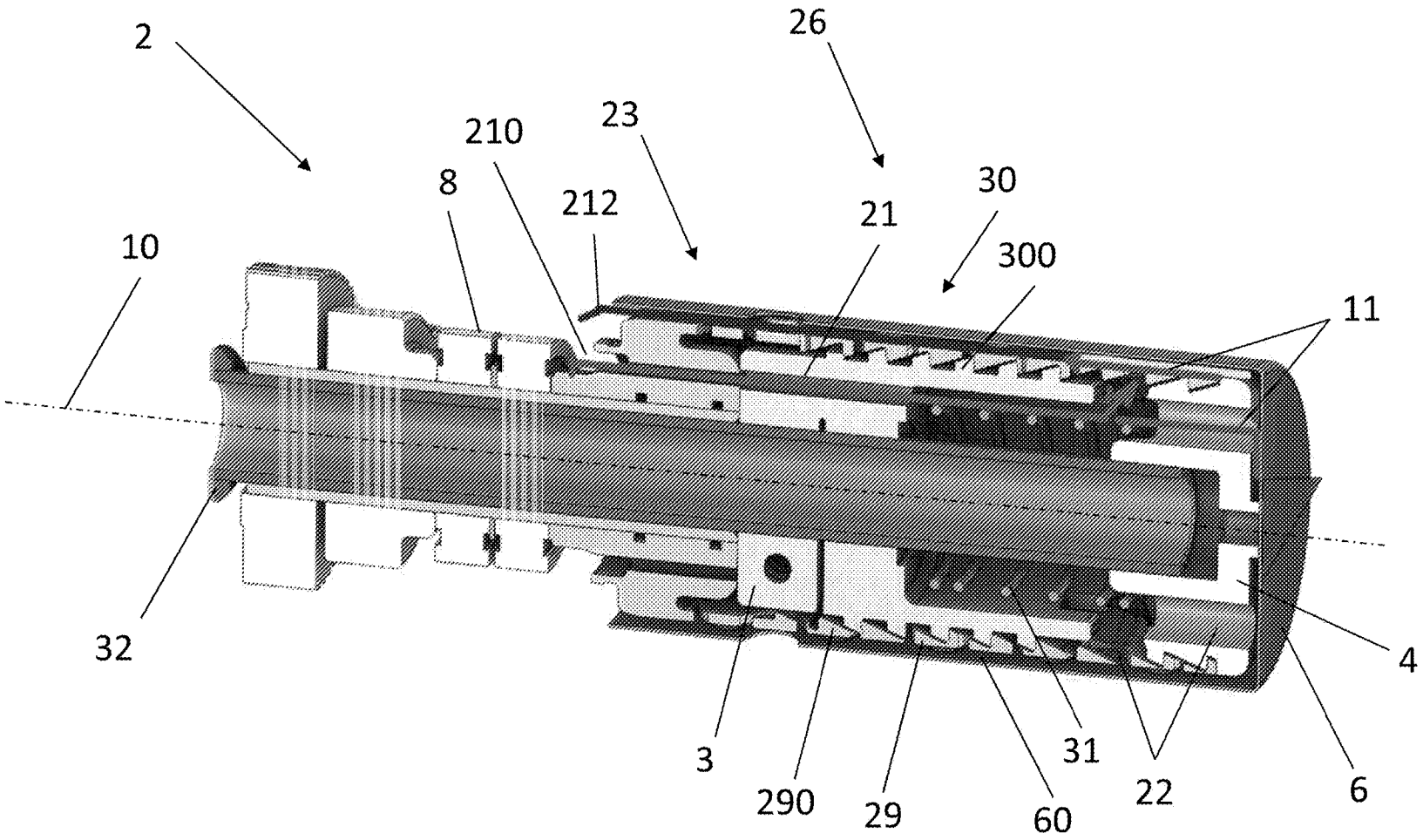
FIG. 5 is a schematically shows a perspective sectional view of a mandrel of the mounting device according to the embodiment shown in FIGS. 1 to 4.

FIG. 5 is a schematic perspective sectional view of a mandrel 2 of the mounting device 1 according to the embodiment shown in FIGS. 1 to 4. The mandrel 2 comprises a mounting sleeve 23 comprising the form of a hollow cylinder, wherein the heating fluid passage 21 is arranged inside the mounting sleeve 23. The mounting sleeve 23 comprises a plurality of openings 22 being in fluid communication with the heating fluid passage 21. Thus, air fed from the heating chamber 57 via the inlet 210 into the heating fluid passages 21 is directed through the openings 22 and comes in contact with an inner surface 60 of the hollow cylindrical object 6. As can be seen in FIG. 6, which is a schematic perspective side view of the mandrel 2, the mounting sleeve 23 comprises a plurality of spacers 25, 25', which are arranged on an outer surface of the mounting sleeve 23 for providing a gap between the outer surface of the mounting sleeve 23 and the inner surface 60 of the hollow cylindrical object 6. The spacers 25, 25' are arranged both on the outer lateral surface of the mounting sleeve 23 and on an outer end face of the mounting sleeve 23 provided by a lid 24 of the mounting sleeve 23. Hence, the gap extends both on the end face and the lateral side of the mounting sleeve 23.

Heated air fed into the gap via the openings 22, thus, comes in contact with a majority of the inner surface 60 of the hollow cylindrical object 6, as the mounting sleeve merely makes contact with the hollow cylindrical object 6 via the spacers 25, 25'.

Hence, an air flow 11 is generated which enters through the inlet 210 into the heating fluid passage 21 into the mandrel 2, and is further directed through the openings 25, 25' into the gap between the mounting sleeve 23 and the hollow cylindrical object 6. As air is constantly supplied to the mandrel, the air present in the gap is pushed towards the lower end of the hollow cylindrical object 6 and to an outlet 212 for the air flow 11. The heated air, thus, heats the inner surface of 60 of the hollow cylindrical object 6 via convection and then leaves the mandrel 2. Thereby, a substantially even heating of the hollow cylindrical object 6 may be obtained.

As the air flow 11 described above would remove the hollow cylindrical object 6 from the mandrel 2 if the hollow cylindrical object 6 was not held in position on the mandrel 2, the mandrel 2 comprises an expansion region 26, which can be expanded in the radial direction with respect to the longitudinal axis 10, such that an outer diameter of the expansion region 26 can be increased and decreased. The mandrel 2 further comprises a core 3 arranged inside the mounting sleeve 23, wherein the core 3 is movable in relation to the mounting sleeve 23 in direction of the longitudinal axis 10. The core 3 is configured to be positioned in a first position of the core 3 relative to the mounting sleeve 23 in which the expansion region 26 is in a not expanded state, and configured to be positioned in a second position of the core 3 relative to the mounting sleeve 23 as shown in FIG. 5, in which the core 3 exerts a radial force onto the expansion region 26 such that the expansion region 26 is radially expanded with regard to the expansion region 26 in the not expanded state.

In the not expanded state, the mounting sleeve 23 comprises a maximum outer diameter slightly smaller than an inner diameter of a hollow cylindrical object 6 to be received by the mandrel 2, and in the expanded state, the mounting sleeve 23 comprises a maximum outer diameter greater than the inner diameter of the cylindrical object 6 to be received by the mandrel. Due to the expansion of the expansion region 26, the mounting sleeve 23 applies a radial force onto the cylindrical lateral wall of the hollow cylindrical object 6, thus, generating a frictional fit between the outer surface of the spacers 25 arranged in the expansion region 26 and the lateral inner surface 60 of the hollow cylindrical object 6, such that the hollow cylindrical object 6 is firmly held in position on the mandrel 2.

The core 3 is located inside the mounting sleeve 23. It comprises a core wedge structure 30 formed by a plurality of wedge ring segments 300 arranged adjacent to each other along the longitudinal axis 10. The core wedge structure 30 is designed in conformity with a plurality of wedge ring segments 290 of a sleeve wedge structure 29 arranged on an inner lateral side of the cylindrical mounting sleeve 23 in the expansion region 26. The core ring segments 300 comprise contact surfaces which they are able to touch complementary formed contact surfaces of wedge ring segments 290 of the mounting sleeve 23. The contact surfaces 37 and the longitudinal axis 10 accordingly enclose an angle, which according to this embodiment comprises 17°. Alternatively, the angle may comprise another value, preferably between 1° and 40°.

According to this embodiment, the mounting sleeve 23 comprises a plurality of slots 27 substantially extending along the longitudinal axis 10 being arranged in a circumferential direction in relation to the longitudinal axis 10 for forming the expansion region 26. The slots 27 are in fluid communication with the heating fluid passage 21, and thus also form and function as the openings 25.

Figure 6:
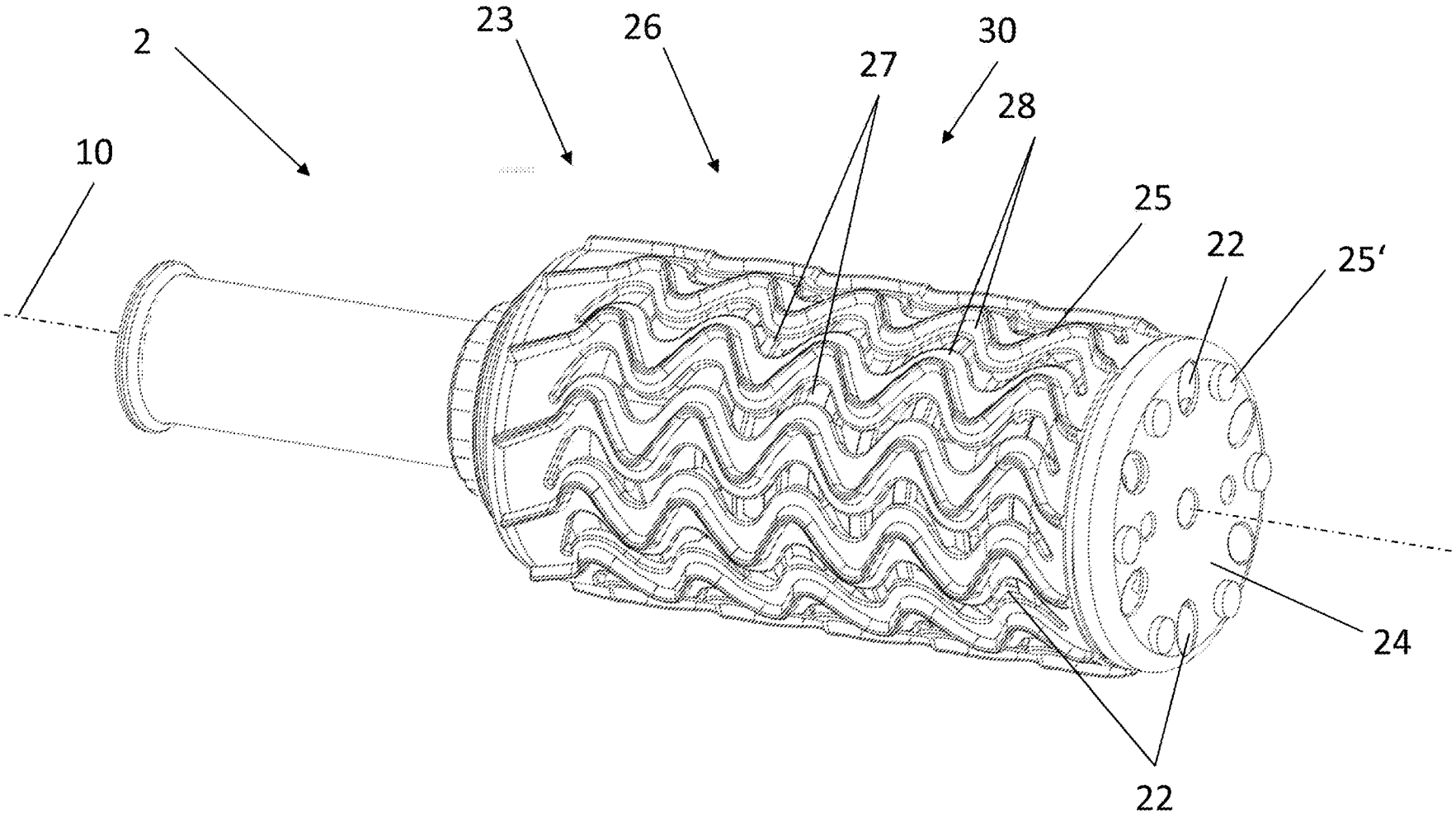
FIG. 6 is a schematically shows a perspective side view of the mandrel of FIG. 5.

As can be seen in FIG. 6, the slots 27 are arranged such that, in the expansion region 26, the mounting sleeve 23 comprises a plurality of ribs 28 extending along the longitudinal axis 10. Thus, each single fin or rib 28 may be bent independently, as the fins or ribs 28 are not connected by each other in the circumferential direction due to the provision of slots 27.

The slots 27 according to this optional embodiment do not extend over the entire length of the mounting sleeve 23 with respect to the longitudinal axis 10, but are arranged in direction of the longitudinal axis 10 between a first end portion of the mounting sleeve 23 (corresponding to a right end portion of the mounting sleeve 23 with regard to the orientation of the mounting sleeve 23 in FIG. 6) and a second end portion of the mounting sleeve 23 (corresponding to a left end portion of the mounting sleeve 23 with regard to the orientation of the mounting sleeve 23 in FIG. 6). Hence, in this optional embodiment, the mounting sleeve 23 comprises end portions being rigid with respect to the expansion region 26, and which consequently do substantially not radially expand due to an exertion of radial force via the core 3 onto the sleeve 23.

For providing a particularly even pressure distribution via the expansion region 26 onto the hollow cylindrical object 6, each slot 27 and thus each rib 28 comprises a sinuous shape. Moreover, each rib 28 comprises a spacer 25 also comprising a substantial sinuous shape.

The core 3 here is biased into the second position as shown in FIG. 5 by a biasing member 31, which in this embodiment comprises the form of a helical compression spring. The core 3 can be moved relative to the mounting sleeve 23 against the biasing force of the biasing member 31 by actuating an actuator 32.

The mounting device 1 further comprises an optional battery (not shown) and an optional contact unit (not shown) which comprises a sliding contact, preferably a brush, for electrical connection with an electrical power supply.

It will be obvious for a person skilled in the art that these embodiments and items only depict examples of a plurality of possibilities. Hence, the embodiments shown here should not be understood to form a limitation of these features and configurations. Any possible combination and configuration of the described features can be chosen according to the scope of the invention.

REFERENCE SIGN LIST

1 Mounting device
2 mandrel
21 heating fluid passage
210 inlet
211 return channel
212 outlet
22 opening
23 mounting sleeve

24 lid
25 spacer
26 expansion region
27 slot
28 rib
29 sleeve wedge structure
290 wedge ring segment
3 core
30 core wedge structure
300 wedge ring segment
31 biasing member
32 actuator
4 lid
5 heating device
50 internal heating unit
51 wire
52 fluid supply conduit
53 fluid return conduit
54 heating area
55 flow generating unit
550 fan
56 tubes
57 heating chamber
58 supply ring chamber
59 return chamber
6 hollow cylindrical object
60 inner surface
61 lateral surface
62 top surface
7 support member
8 bearing
9 center axis
10 longitudinal axis
11 air flow

The invention claimed is:

1. A mounting device for holding a hollow cylindrical object in a printing system, comprising:

a support member, and a mandrel for receiving the hollow cylindrical object arranged at the support member, characterized by a heating device for heating the hollow cylindrical object mounted at the mandrel, wherein the heating device comprises a fluid supply conduit for supplying a flow of heating fluid to the mandrel, wherein the mandrel comprises a heating fluid passage for directing the flow of fluid towards an inner surface of the hollow cylindrical object;

wherein the mandrel comprises a mounting sleeve comprising a form of a hollow cylinder, and wherein one or more spacers are arranged on an outer surface of the mounting sleeve for providing a gap between the outer surface of the mounting sleeve and an inner surface of the hollow cylindrical object.

2. The mounting device according to claim 1, wherein the heating device is configured to heat the hollow cylindrical object from an outer side of the hollow cylindrical object, and/or wherein the heating device is configured to heat the hollow cylindrical object from an inner side of the hollow cylindrical object.

3. The mounting device according to claim 1, wherein the heating device comprises an internal heating unit.

4. The mounting device according to claim 3, wherein the internal heating unit comprises a heat source.

5. The mounting device according to claim 4, wherein the internal heating unit is arranged to heat an outer surface of the mandrel and/or the heating unit is arranged to heat a fluid being directed to the mandrel.

6. The mounting device according to claim 4, wherein the internal unit comprises a heating wire.

7. The mounting device according to claim 4, wherein the internal heating unit comprises a plurality of heating wires.

8. The mounting device according to claim 1, wherein the heating device comprises a wireless induction unit for wireless induction heating of the hollow cylindrical object, and/or the heating device comprises an infrared heating unit for emitting infrared radiation.

9. The mounting device according to claim 8, wherein the fluid is air.

10. The mounting device according to claim 1, wherein the heating fluid passage is arranged inside the mounting sleeve.

11. The mounting device according to claim 1, wherein the one or more spacers are arranged on an outer lateral surface of the mounting sleeve and/or on an outer end face of the mounting sleeve.

12. The mounting device according to claim 1, wherein the mounting sleeve extends along a longitudinal axis and comprises an expansion region, wherein the mandrel further comprises a core arranged inside the mounting sleeve, wherein the core is movable in relation to the mounting sleeve, wherein the core is configured to be positioned in a first position of the core relative to the mounting sleeve in which the expansion region is in a not expanded state, and configured to be positioned in a second position of the core relative to the mounting sleeve in which the core exerts a radial force onto the expansion region such that the expansion region is radially expanded with regard to the expansion region in the not expanded state.

13. The mounting device according to claim 12, wherein in the not expanded state, the mounting sleeve comprises a maximum outer diameter equal to or slightly smaller than an inner diameter of a hollow cylindrical object to be received by the mandrel, and in the expanded state, the mounting sleeve comprises a maximum outer diameter greater than the inner diameter of the hollow cylindrical object to be received by the mandrel.

14. The mounting device according to claim 12, wherein the mounting sleeve comprises a plurality of slots substantially extending along the longitudinal axis being arranged in a circumferential direction in relation to the longitudinal axis for forming the expansion region.

15. The mounting device according to claim 14, wherein the slots are arranged such that, in the expansion region, the mounting sleeve comprises a plurality of ribs extending along the longitudinal axis.

16. The mounting device according to claim 14, wherein the slots are in fluid communication with the heating fluid passage.

17. The mounting device according to claim 15, wherein each rib comprises a spacer.

18. The mounting device according to claim 15, wherein one or more ribs comprise a spacer.

19. The mounting device according to claim 1, wherein the heating device comprises a flow generating unit for providing a fluid flow, preferably an air flow in the heating device.

20. The mounting device according to claim 19, wherein the flow generating unit is a pump or fan.

21. The mounting device according to claim 19, wherein the fluid flow is an air flow.

22. The mounting device according to claim 1, wherein the heating device comprises a fluid return conduit for redirecting fluid from the mandrel towards a heating unit.

23. The mounting device according to claim 1, wherein the mandrel is rotary supported on the support member.

24. The mounting device according to claim 23, wherein the heating device comprises a heating area arranged adjacent to the mandrel for heating an outer lateral surface of the hollow cylindrical block.

25. The mounting device according to claim 1, wherein a plurality of mandrels is arranged on the support member in a circumferential direction about a center axis.

26. The mounting device according to claim 25, wherein the support member is rotatable about the center axis.

27. The mounting device according to claim 1, wherein the hollow cylindrical object is a screw cap.

* * * * *